United States Patent [19]

Diefendorf et al.

[11] 4,331,620

[45] May 25, 1982

[54] PROCESS FOR PRODUCING CARBON FIBERS FROM HEAT TREATED PITCH

[75] Inventors: Russell J. Diefendorf, Clifton Park, N.Y.; Dennis M. Riggs, Milford, Mass.

[73] Assignee: Exxon Research & Engineering Co., Florham Park, N.J.

[21] Appl. No.: 123,933

[22] Filed: Feb. 25, 1980

[51] Int. Cl.[3] ..... C01B 31/07

[52] U.S. Cl. ..... 264/29.2; 264/108; 264/176 F; 423/447.4; 423/447.6

[58] Field of Search ..... 264/29.2, 108, 176 F, 264/29.1; 423/448

[56] References Cited

U.S. PATENT DOCUMENTS

| | | | |
|---|---|---|---|
| 1,700,208 | 1/1929 | Paisseau | 264/108 |
| 2,485,523 | 10/1949 | Ashbaugh | 425/162 |
| 3,168,509 | 2/1965 | Juel | 264/108 |
| 3,350,485 | 10/1967 | Shesler et al. | 264/108 |
| 3,467,743 | 9/1969 | Otani | 264/176 F |
| 3,584,095 | 6/1971 | Heider et al. | 264/108 |
| 3,666,847 | 5/1972 | Bailey | 264/108 |
| 3,676,535 | 7/1972 | Juel | 264/108 |
| 3,787,541 | 1/1974 | Grindstaff et al. | 423/448 |
| 3,856,926 | 12/1974 | Yamaura et al. | 423/448 |
| 3,919,376 | 11/1975 | Schulz | 264/102 |
| 3,974,264 | 8/1976 | McHenry | 264/29.2 |
| 3,990,829 | 11/1976 | Frank et al. | 425/376 R |
| 4,057,610 | 11/1977 | Goettler et al. | 264/108 |
| 4,209,500 | 6/1980 | Chwastiak | 264/29.2 |
| 4,213,956 | 7/1980 | Ubbelohde | 264/29.1 |
| 4,218,222 | 8/1980 | Nolan et al. | 264/142 |

FOREIGN PATENT DOCUMENTS

| | | | |
|---|---|---|---|
| 1150189 | 6/1955 | France | 264/108 |
| 1150189 | 1/1958 | France | 264/329 |
| 39-9154 | 6/1964 | Japan | 264/108 |
| 45-34479 | 11/1970 | Japan | 264/108 |
| 125538 | 9/1928 | Switzerland | 264/108 |
| 1050107 | 12/1966 | United Kingdom | 264/176 Z |

*Primary Examiner*—Jay H. Woo

*Attorney, Agent, or Firm*—Lawrence Rosen

[57] ABSTRACT

Heat treated pitches, especially pitches containing either isotropic or anisotropic phases as well as mixtures thereof, are spun by subjecting the pitch at spinning temperatures to shearing forces while simultaneously spinning the pitch.

12 Claims, 1 Drawing Figure

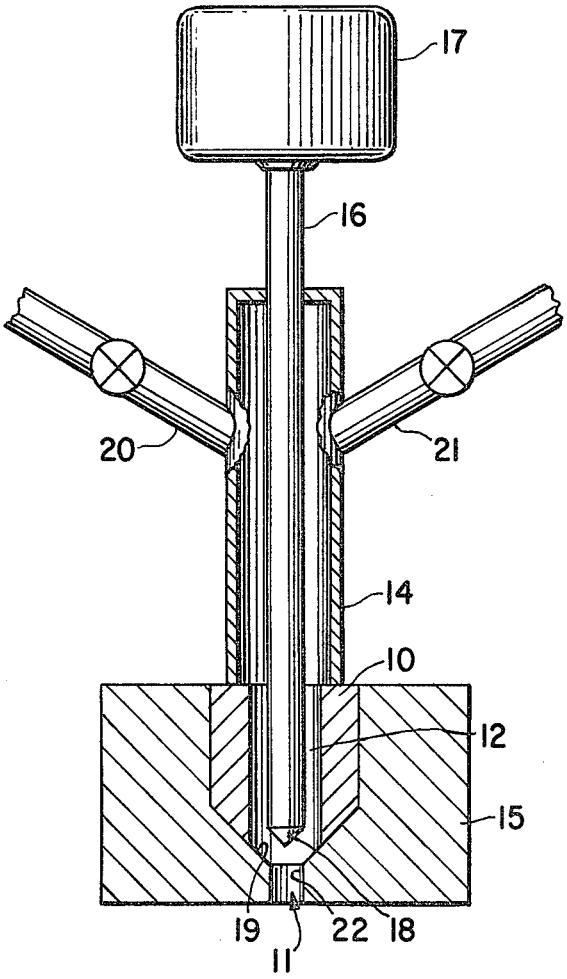
17
16
20
21
14
10
12
15
19
22
18
11

PROCESS FOR PRODUCING CARBON FIBERS FROM HEAT TREATED PITCH

BACKGROUND OF THE INVENTION

1. Field of the Invention

This invention relates generally to an improved process for producing fibers from heat treated pitches which contain either isotropic or anisotropic phases as well as mixtures thereof, the anisotropic phase being liquid crystals of the mesophase or neomesophase states.

2. Description of the Prior Art

The use of carbon fibers, such as graphite fibers, in reinforcing plastic and metal matrices has gained considerable commercial acceptance where the exceptional properties of the reinforced composite materials clearly offset the generally high cost associated with preparing them. It is generally accepted that large-scale use of carbon fibers as a reinforcing material would gain even greater acceptance in the marketplace if the costs associated with the formation of the fibers could be substantially reduced. Thus, the formation of carbon fibers from relatively inexpensive pitches has received considerable attention in recent years. In this regard, mention is made of the following representative U.S. Pat. Nos. 3,191,387; 3,629,979; 3,919,376; 3,558,276; 3,668,110; 3,787,541; 3,718,493; 3,767,741 and 4,005,183.

Use of relatively inexpensive pitch materials, however, has not substantially reduced the cost of the formation of carbon fibers. In order to produce a carbon fiber that has the requisite stiffness characteristics, it is necessary to thermally transform the carbonaceous pitch, at least in part, to a liquid crystal or the so-called mesophase or neomesophase state. The term "neomesophase" is defined in U.S. patent application Ser. No. 903,172, now U.S. Pat. No. 4,208,267, and the corresponding British Pat. No. 2,002,024; which definition is incorporated herein by reference. The thermal conversion of an isotropic pitch to a mesophase containing pitch has been very expensive, particularly in terms of mesophase production rate. For example, at 350° C., the minimum temperature generally required to convert an isotropic pitch to an anisotropic pitch, at least one week of heating is usually necessary; and then the mesophase content of the pitch is only about 40%. In addition thereto, the formation of fibers from pitches containing as much as 60% of mesophase material, for example, still requires extensive and costly post-spinning treatments in order to provide a carbon fiber which has the requisite Young's modulus of elasticity and tensile strength, rendering these fibers commercially attractive and important.

More recently, there has been discovered a process for forming an optically anisotropic, deformable pitch in exceedingly short periods of time. The ability to spin such pitches obviously would lead to significant reduction in process costs as well as provide carbon fibers with, at the very least, commercially acceptable physical properties.

It should be noted here that in first converting carbonaceous pitches to a material which has a mesophase content greater than 40% by weight, it is generally considered necessary that the mesophase material be present under quiescent conditions as a homogeneous bulk mesophase having large coalesced domains, i.e. domains of aligned molecules in excess of 200 microns, up to an excess of 1000 microns in size. Pitches, for example, which form stringy bulk mesophase under quiescent conditions generally are considered to have exceedingly high viscosities which are detrimental to forming fibers of uniform size.

Additionally, carbonaceous pitches produced by simple heat treatment which have a mesophase content of greater than 40% by weight have viscosities which increase with increasing mesophase content. In general, the higher the mesophase content, the more difficult the material is considered to be to spin because of the higher viscosity and more thixotropic nature of the pitch. In U.S. Pat. No. 3,974,264, for example, it is indicated that in forming carbon fibers from mesophase pitch, it is particularly desirable to use one which has a mesophase content of 50 to 65% by weight for ease of spinning. As indicated in this patent, mesophase pitches having a mesophase content of about 90% by weight exhibit viscosities of the order of about 200 poise at temperatures above 430° C.; consequently, heating such high mesophase content pitches to elevated temperatures at which such pitches would exhibit a suitable viscosity for spinning generally requires heating to temperatures in the range where coking, a competing detrimental process, is likely to occur.

In providing high-modulus, high-strength carbon fibers, it generally is considered highly desirable that the carbon fibers have a highly oriented structure characterized by the presence of carbon crystallites, preferably such crystallites being aligned parallel to the fiber axis. Mesophase pitches do contain anisotropic material which is of a highly oriented nature. As could be expected, the higher the mesophase or neomesophase content, the greater the degree of orientation likely to be achieved in the resultant fiber and also the faster the pitch fiber is likely to be converted to a carbon fiber. But the greater the mesophase content, the higher the temperature necessary to obtain a viscosity for the mesophase pitch which is capable of being spun. This higher spinning temperature, however, is detrimental to the pitch stability. As a consequence thereof, it would appear that these two main requirements for a useful pitch in forming carbon fibers, i.e. high degree of orientation and Newtonian flow properties, are mutually exclusive.

It has also been recognized that, contrary to previously accepted theory, the amount of mesophase is not necessarily equal to the amount of quinoline insolubles in pitch formed by heat treatment. In fact, the mesophase can include both high molecular weight components which are quinoline insoluble and lower molecular weight components which are soluble.

SUMMARY OF THE INVENTION

Generally speaking, it has now been discovered that anisotropic pitches, and particularly anisotropic pitches which also are mixed with some isotropic components and which do not exhibit Newtonian or plastic flow at spinning temperatures of between about 280° C. to 450° C., can be spun into uniform fibers which can be converted by further heat treatment into carbon fibers having a high Young's modulus of elasticity and high tensile strength by subjecting the mesophase containing pitch to a shearing force. Consequently, heat treated pitches having mesophase or neomesophase contents greater than about 65% by weight, and, indeed mesophase or neomesophase pitches containing greater than 90% by weight, can be spun by simultaneously spinning and subjecting such pitches at temperatures below 460°

C. to a shearing force in an amount sufficient to cause the liquid crystals or the domains to be oriented in a fine domain structure parallel to shear direction.

It will be understood that isotropic pitches, which are non-Newtonian, can also be employed in the process of this invention. Such isotropic pitches would include those which have been heated above the mesophase isotropic transition temperature.

Although the exact mechanism involved in the present process is not fully understood at this time, it has been found that the rheological behavior is often similar to gel breakdown. This could be a possible explanation for the effectiveness of present process in the treatment of isotropic pitches.

In another embodiment of the present invention, an apparatus for spinning heat treated pitches is provided including a spinning die having an orifice therein, and high shear stirring means located within the spinning die.

The major details and the utility of the invention will be more clearly apparent from the following detailed description when read in conjunction with the accompanying drawings.

BRIEF DESCRIPTION OF THE DRAWINGS

The sole FIGURE is a schematic diagram of an apparatus of the present invention suitable for subjecting heat treated, optically anisotropic pitches to shearing forces whereby such pitches can be spun.

DETAILED DESCRIPTION OF THE INVENTION

Any isotropic carbonaceous pitch capable of being thermally converted to an anisotropic pitch fusible at temperatures below the coking temperature of the pitch and having a viscosity in the range of about 10 to 200 poise can be used in the practice of the present invention. Such so-called "graphitizing" pitches are well known. Thus, petroleum pitches, coal tar pitches, natural asphalts, pitches obtained as by-products in the naphtha cracking industry and pitches of high carbon content obtained from petroleum asphalt and other substances, all of which are well known graphitizing pitches, can be heated to temperatures of about 350° C. to 450° C. for a time sufficient to convert at least a portion of the pitch to the mesophase. For example, carbonaceous pitches having a mesophase or a neomesophase content of from about 40% by weight up to about 90% by weight can be produced by heating a carbonaceous pitch in an inert atmosphere at a temperature of about 350° C. for a time sufficient to produce the desired quantity of liquid crystals. As is readily appreciated, the heating period required to produce the desired mesophase or neomesophase content will vary with the particular pitch and the temperature employed.

In the practice of the present invention, it is particularly preferred to employ a solvent insoluble fraction of such graphitizable pitches which fraction, hereinafter referred to as concentrated mesophase former, is converted to a pitch containing greater than 90% optically anisotropic liquid crystalline material at temperatures in the range of from about 230° C. to about 450° C., generally in less than ten minutes and especially in less than one minute. As set forth above, the technique for preparing the concentrated mesophase former fraction is disclosed in copending application Ser. No. 903,172.

Generally stated, typical graphitizing pitches containing less than 5 wt. % quinoline insolubles are treated with sufficient solvent or mixture of solvents to leave a solvent insoluble fraction which is characterized by: a sintering point from about 310° C. to about 340° C. as determined by differential thermal analysis of a sample of the insoluble material in the absence of air; a carbon-to-hydrogen ratio greater than about 1.4 and especially between about 1.8 to 2.0; and, the rapidity with which the material is converted to 90% or greater optically anisotropic liquid crystalline material when heated at temperatures between 230° and 450° C. The ratio of solvent-to-isotropic pitch used to isolate the solvent insoluble concentrated neomesophase or mesophase former fraction will vary, of course, depending upon the nature of the isotropic pitch, the choice of solvent, extracting temperature and the like. As a general guide, however, at least 75% by weight and preferably about 80% to 90% by weight of the graphitizing pitch should be solubilized with a suitable aliphatic hydrocarbon such as hexane and heptane or aromatic hydrocarbon such as benzene and toluene leaving a concentrated mesophase former fraction having a sintering point of below about 340° C. The choice of solvents is quite broad and depends upon the particular pitch. Generally, however, any organic solvent or mixture of solvents having a solubility parameter of between about 8.0 to 9.5 is suitable.

The solubility parameter, δ, of a solvent or mixture of solvents, is given by the expression $$\delta = \left( \frac{\Delta H_v - RT}{V} \right)^{\frac{1}{2}}$$

where $H_v$ is the heat of vaporization of the material;

R is the molar gas constant;

T is the temperature in °K; and

V is the molar volume.

In this regard, see, for example, J. Hildebrand and R. Scott, "Solubility of Non-Electrolytes", 3rd edition, Reinhold Publishing Co., NY (1949) and "Regular Solutions", Prentice Hall, NJ (1962). The solubility parameters at 25° C. for some typical organic solvents are as follows: benzene, 9.0; toluene, 8.8; xylene, 8.7; and cyclohexane, 8.2. As is well known, solvent mixtures can be prepared also to provide a solvent with a desired solubility parameter.

In any event, whether the anisotropic feed material pitch is prepared by heating an isotropic pitch at elevated temperatures to produce a pitch having a mesophase content greater than 40% by weight or by heating a concentrated mesophase former fraction from a graphitizing pitch to produce a pitch having an optically anisotropic liquid crystalline content greater than 90% by weight, it is preferred that the anisotropic pitch used in the practice of the present invention have a viscosity in the range of from about 10 poise to about 200 poise at a temperature of from about 230°. C. to about 450° C. It is especially preferred that the anisotropic pitch used in the practice of the present invention have an optically anisotropic liquid crystalline content of greater than 90% by weight.

As already indicated, anisotropic pitches having an optically anisotropic content greater than 90% by weight, for example, are generally thixotropic, i.e., they do not generally exhibit a Newtonian flow behavior at spinning temperatures and generally are considered difficult, if not impossible, to spin.

This invention takes advantage of the highly anisotropic regions in such pitches and the ability to orient the large coalesced regions in the pitch to produce more Newtonian-like viscosity characteristics. This orientation of the large coalesced domains is accomplished by introducing a shearing force in a plane normal to the desired direction of flow and in an amount sufficient to cause the large coalesced domains, e.g., those having diameters of about 100μ in size, to be oriented in a fine domain structure, e.g., domains having diameters of 10μ to 20μ in size, parallel to the shear direction and hence normal to the spinning or flow direction. The same shearing action would also cause gel breakdown to occur in these pitches. The relative importance of these two factors depends on the nature of the pitches employed as feed material. This technique will be more readily appreciated by referring to the sole FIGURE which schematically sets forth an apparatus particularly useful in the practice of the present invention.

Basically, the apparatus consists of a spinning die 10 having an orifice 11 through which the mesophase containing pitch is extruded into cavity 22. The spinning die has a generally cylindrical cavity 12 which is in direct and sealed communication with tube 14 through which the pitch can be charged into the die 10. Spinning die 10 is mounted within a heating block or furnace 15. A rotor 16 is located axially in cavity 12 and tube 14. It is connected to stirring motor 17 at the top. Rotor 16 has a conical tip of substantially the same contour as the contour of cavity 12 in the immediate vicinity of orifice 11. The rotor 16 is so positioned within cavity 12 such that the conical tip 18 of rotor 16 is spaced with respect to the downwardly converging sidewall 19 of spinning die 10 in the vicinity of orifice 11 so as to provide for a very narrow channel through which the mesophase pitch may pass. This concentric channel will be generally of the same width as the diameter of the orifice 11; however, it can range upwardly to 5 times the diameter of orifice 11. Conduit means 20 are provided for introducing an inert gas into tube 14 under pressure. Similarly, conduit means 21 is provided for introducing the requisite pitch for spinning. Motor 17 is a high torque electric motor; however, any other drive means which will generate sufficient torque may be employed.

Use of the foregoing apparatus will be described now in particular with specific reference to an anisotropic pitch having a mesophase content of greater than 90% by weight and a viscosity between about 10 poise and 200 poise at a temperature in the range of about 230° C. to about 450° C. However, it will be appreciated that other anisotropic or isotropic pitches, which tend to exhibit non-Newtonian flow behavior, can be spun by the techniques disclosed herein.

Returning again to the drawing, an anisotropic pitch having a mesophase content greater than about 90% by weight, and alternatively a neomesophase concentrated mesophase former fraction of an isotropic pitch, is introduced into the spinning mechanism via conduit 21. The temperature of the spinning die preferably has been preheated by furnace 15, typically to a temperature above 230° C. and generally to the range of between 360° C. to about 450° C. Indeed, the temperature of the spinning die is maintained at the preheat temperature, i.e., the desired spinning temperature throughout the spinning process. As soon as the mesophase or neomesophase pitch is charged into the die via conduit 21 and it reaches the requisite spinning temperature, e.g., of 230° C. to 450° C., the motor is actuated, driving rotor 16 so as to introduce a very high shear. The speed of stirring, i.e., shear rate, should be sufficient to orient the large coalesced domains in a fine domain structure parallel to the shear direction or to convert the isotropic as well as the anisotropic components into a single phase, thereby rendering the pitch nonthixotropic. Alternatively, in some instances the speed of stirring must be sufficiently high to achieve gel breakdown.

For anisotropic pitches having viscosities of 10 to 200 poise at spinning temperatures of 230° C. to 450° C., a stirring rate of from about 50 to 3000 rpm is required to spin the pitch through a 1/16" diameter die having a length to diameter ratio of 4 and a stirrer to die space of 1/16".

As indicated above, the pitch is heated in the die and shear is introduced in a plane normal to the spinning direction by rotating the stirrer at high speed rates. Then spinning is begun; however, it should be noted that there generally is a time lag of between about 20 seconds to about 1 minute from the time that stirring has begun to the time when good continuous optically anisotropic containing fibers can be spun. This time lag may be due to nonsheared mesophase material being present in the immediate vicinity of the die orifice.

In accordance with one of the preferred methods of carrying out the present invention, the heated pitch is spun at right angles to the shear direction.

After spinning, the fiber can be carbonized by heating in an oxygen containing atmosphere, such as air, at temperatures below the softening point of the anisotropic pitch, e.g., between about 250° C. and 400° C., for a time sufficient to render it infusible. Thereafter the infusible fiber is heated in an inert atmosphere such as nitrogen at temperatures of up to about 2000° C. and even higher to convert it to a carbon fiber. Indeed, when the fiber is prepared from a mesophase pitch containing from about 40% to about 90% mesophase, generally the infusible fiber will be heated to a temperature in the range of about 1750° C. to 2000° C. in an inert atmosphere to carbonize it. When the pitch fiber is prepared from a neomesophase or a concentrated mesophase former fraction of a carbonaceous isotropic pitch, generally heating in an inert atmosphere at about 1000° C. will carbonize the fiber.

A more complete understanding of the process of this invention can be obtained by reference to the following example which is illustrative only and is not meant to limit the scope thereof which is fully expressed in the hereinafter appended claims.

EXAMPLE

A commercially available isotropic carbonaceous pitch containing less than about 5 wt. % quinoline insolubles was extracted with benzene at ambient temperatures to provide a concentrated mesophase former fraction. Specifically, 0.5 kg of Ashland 260 pitch was mixed for 24 hours at ambient temperatures with 4 l of benzene. The benzene insoluble material thereafter was separated by filtration. The insoluble material was washed with 1500 ml of benzene and thereafter with 2000 ml of benzene and air dried. Differential thermal analysis of a sample of the benzene insoluble material showed a sintering temperature of below about 350° C. Thermal gravimetric analysis of the sample of benzene insoluble material indicated a weight loss, when heated to 380° C. at a heating rate of about 10° per minute, of less than about 3 wt. %. Photomicrographic examination of the so-heated sample under polarized light showed an optically anisotropic liquid crystalline content of about 95%.

The concentrated mesophase former fraction prepared in the manner outlined above is charged into a die having an orifice diameter of 1/64" and a length to diameter ratio of 1 to 8. The charge was heated at 10° C. per minute to a temperature of 380° and thereafter maintained at that temperature under an inert gas pressure of about 5 psi. The heated pitch consistently formed droplets at the die orifice; however, only fibers with a length of about several centimeters could be drawn. Thereafter the pitch was subjected to shearing forces by initiating the stirring motor 17. When rotor was driven at rotational speeds ranging between 50 rpm to 200 rpm, good continuous fibers could be drawn. By increasing the rotor speed up to 2800 rpm, continuous lengths of fibers were withdrawn at the rate of about 600 feet per minute.

The anisotropic pitch fiber which had been drawn was cooled to room temperature. Subsequently it was oxidized by heating the fiber in air at 280° C. for 20 minutes. Thereafter the fiber was heated in an inert nitrogen atmosphere at 1000° C. to carbonize the oxidized fiber. The fibers so produced were found to have a Young's modulus of $21\times10^6$ psi.

What is claimed is:

1. The process for producing a carbonaceous pitch fiber capable of being thermoset and converted thermally to carbon fiber comprising: heating a non-Newtonian carbonaceous pitch selected from the group consisting of anisotropic pitch, isotropic pitch, and mixtures thereof to spinning temperatures; subjecting said carbonaceous pitch to shearing forces for spinning said heated pitch to form said fiber, said shearing forces being at least sufficient at spinning temperatures to orient large domains in said pitch into a fine domain structure parallel to the shear direction and to cause gel breakdown.

2. The process of claim 1 wherein said heated pitch is spun at right angles to the direction of shearing forces.

3. The process of claim 1 wherein said carbonaceous pitch has a viscosity in the range of 10 to 200 poise at temperatures in the range of 230° to 450° C.

4. The process of claim 3 wherein said carbonaceous pitch contains greater than 65 wt. % optically anisotropic liquid crystalline domains.

5. The process of claim 4 wherein said pitch contains greater than 90 wt. % optically anisotropic liquid crystalline domains.

6. The process of claim 5 wherein said spinning temperatures are in the range of from about 230° C. to 450° C.

7. The process of claim 1 wherein said pitch is an isotropic pitch.

8. A process for producing a carbonaceous pitch fiber capable of being thermoset and converted thermally to a carbon fiber, said pitch fiber having an optically anisotropic content greater than 90% by weight comprising: subjecting an anisotropic, non-Newtonian pitch containing greater than 90% optically anisotropic domains at spinning temperatures to a shearing force and spinning said heated pitch to form said fiber, said shearing forces being at least sufficient at spinning temperatures to orient large optically anisotropic domains into a fine domain structure parallel to the shear direction and to cause gel breakdown.

9. The process of claim 8 wherein said heated pitch is spun at right angles to the direction of shearing forces.

10. The process for forming a pitch fiber comprising: providing an isotropic carbonaceous pitch which is insoluble in benzene at ambient temperatures and which pitch when heated to a temperature in the range from about 230° C. to 450° C. is converted to an optically anisotropic pitch containing greater than 90% optically anisotropic domains; heating said isotropic pitch at a temperature in the range of from about 230° C. to about 450° C. for a time sufficient to convert said isotropic pitch to an optically, non-Newtonian, anisotropic pitch containing greater than 90% optically anisotropic domains; maintaining the temperature of said optically anisotropic pitch in the temperature range of between about 230° C. to 450° C. in the spinning die; subjecting said heated pitch to shearing forces for spinning said pitch whereby a pitch fiber is obtained, said shearing forces being at least sufficient at spinning temperatures to orient large optically anisotropic domains into a fine domain structure parallel to the shear direction and to cause gel breakdown.

11. The process of claim 10 wherein said heated pitch is spun at right angles to the shear direction.

12. The process of claim 10 including the steps of heating said pitch fiber in a temperature range of between about 250° C. to 400° C. and an oxidizing atmosphere to render the fibers infusible and thereafter carbonizing said oxidizing fiber by heating at temperatures up to 2000° C. whereby a carbon fiber is obtained.

* * * * *